United States Patent [19]

Ikegami

[11] 4,408,896

[45] Oct. 11, 1983

[54] CORRECTING MECHANISM FOR HYBRID DISPLAY TIMEPIECE

[75] Inventor: Toshimasa Ikegami, Suwa, Japan

[73] Assignee: Kabushiki Kaisha Suwa Seikosha, Tokyo, Japan

[21] Appl. No.: 271,150

[22] Filed: Jun. 8, 1981

[30] Foreign Application Priority Data

Jun. 6, 1980 [JP] Japan ..... 55-78813

[51] Int. Cl.[3] ..... G04B 19/24; G04B 19/00; G04C 3/00; G04G 9/00

[52] U.S. Cl. ..... 368/185; 368/34; 368/69; 368/308; 368/319

[58] Field of Search ..... 368/34, 69–71, 368/185–187, 308, 319–321

[56] References Cited

U.S. PATENT DOCUMENTS

| | | | |
|---|---|---|---|
| 4,095,405 | 6/1978 | Tanaka | 368/34 |
| 4,232,510 | 11/1980 | Tamaru et al. | 368/185 X |
| 4,236,240 | 11/1980 | Yoshida | 368/34 X |
| 4,253,173 | 2/1981 | Jaunin | 368/34 X |
| 4,259,735 | 3/1981 | Vuille | 368/34 |
| 4,271,494 | 6/1981 | Miyazaki | 368/34 |
| 4,362,391 | 12/1982 | King et al. | 368/34 |

*Primary Examiner*—J. V. Truhe
*Assistant Examiner*—Terrance Flower
*Attorney, Agent, or Firm*—Blum, Kaplan, Friedman, Silberman & Beran

[57] ABSTRACT

A timepiece having both analog and digital display includes a single stem operated correcting mechanism which adjusts each display independently. A correcting pinion, slidably mounted on a winding stem, provides for engagement at both ends thereof. In a first axial position of the winding stem, one end of the pinion engages a wheel train for correcting the analog display when the stem is rotated. In a second axial position of the winding stem, the correcting pinion engages a spring biased cam whereby electrical switches are intermittently opened and closed when the stem is rotated for correcting the digital display. Advancement or retardation of the displays depends on the direction of stem rotation.

16 Claims, 9 Drawing Figures

FIG. 7
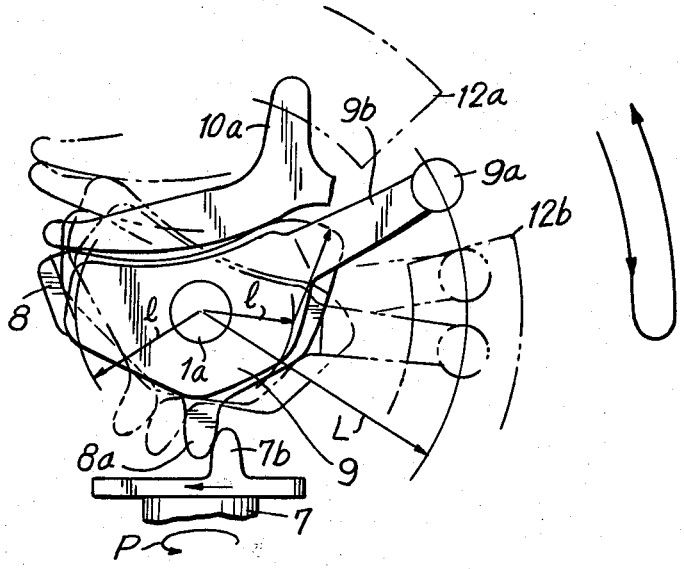
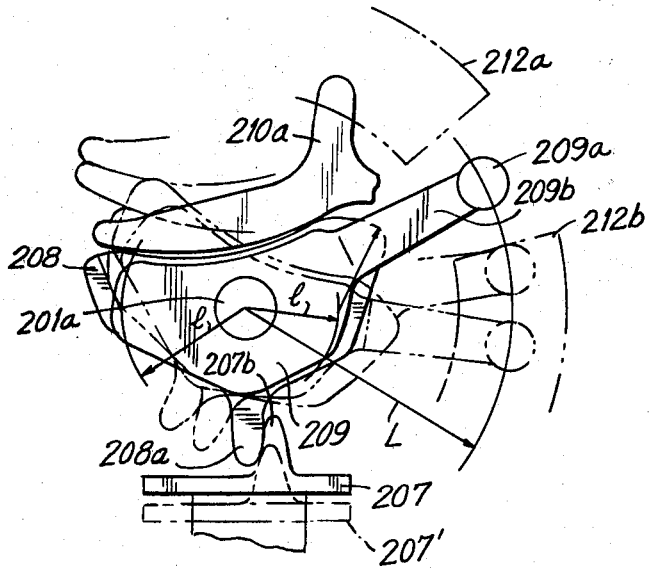
FIG. 8

CORRECTING MECHANISM FOR HYBRID DISPLAY TIMEPIECE

BACKGROUND OF THE INVENTION

The correcting mechanism for a hybrid display timepiece of the prior art uses a combination of a crown and buttons for correcting the analog display and a button for correcting the digital display. However, because the digital correction was performed by a combination of many button operations, operability is very poor. In another method of correction, digital correction is performed by a rotating member such as a crown. However, in this mechanism, the structure became highly complicated and production costs are increased. Generally speaking, the disadvantages of the conventional methods are as follows: 1. The operating method is very complicated. 2. The number of external operational members, such as a crown or button, is large. 3. A large number of buttons and crown reduces the water-proofing integrity of the case and raises the cost of producing the case. 4. The number of components which are required is large. 5. An integrated circuit for detecting the position and rotation of the stem is complicated. 6. Power consumption is high. Items 1–3 are particularly pertinent in applications using buttons and items 4–6 are particularly pertinent in the applications using a winding device.

What is needed is a correcting mechanism for a hybrid display timepiece which is simple and reliable in operation and requires few components located internally and externally.

SUMMARY OF THE INVENTION

Generally speaking, in accordance with the invention, a correcting mechanism for a hybrid display timepiece especially suitable for simplified construction and operation is provided. The timepiece having both analog and digital display includes a single stem operated correcting mechanism which adjusts each display independently. A correcting pinion, slidably mounted for rotation on a winding stem, provides for engagement at both ends thereof. In a first axial position of the winding stem, one end of the pinion engages a wheel train for correcting the analog display when the stem is rotated. In a second axial position of the winding stem, the correcting pinion engages a spring biased cam whereby electrical switches are intermittently opened and closed when the stem is rotated for correcting the digital display. In both cases, advancement or retardation of the displays depends on the direction of stem rotation. The stem has a neutral position when the timepiece is normally worn or carried, wherein all switches for correction are open and the correcting pinion is in a neutral disengaged condition. Thus, power is conserved. A single stem which is both rotatable about the longitudinal axis and translatable along the longitudinal axis serves for correcting both the analog and digital displays.

Accordingly, it is an object of this invention to provide an improved correcting mechanism for a hybrid display timepiece having a simplified external structure and requiring simple precedures for operation.

A further object of this invention is to provide an improved correcting mechanism for a hybrid display timepiece having a simplified external structure and requiring simple procedures for operation.

A further object of this invention is to provide an improved correcting mechanism for a hybrid display timepiece wherein the same rotations of an external crown provide the same corrections in both the analog and digital displays.

A further object of this invention is to provide an improved correcting mechanism for a hybrid display timepiece which simply provides for either advancement or retardation of the display.

Still another object of this invention is to provide an improved correcting mechanism for a hybrid display timepiece which is not readily engaged through inadvertence and conserves energy in the battery.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 5–7 are portions of the plan view of FIG. 3 to an enlarged scale, indicating different operational modes;

FIG. 8 is a view similar to FIG. 7 for an alternative embodiment of a correcting mechanism in accordance with this invention.

DESCRIPTION OF THE PREFERRED EMBODIMENTS

The correcting mechanism in accordance with this invention is for use in a hybrid display timepiece having both an analog display which includes hands and a digital display using electro-optical display means such as a liquid crystal. Conventionally, the display correction of a hybrid display timepiece has been performed such that the analog display is corrected by means of a crown. On the other hand, the digital display is corrected by a combination of operations of a plurality of buttons as is used in the correcting mechanism for a conventional digital timepiece not having an analog display. Such a hybrid timepiece using both correcting systems is explicitly labelled to identify the functions of the buttons on an observable portion of the timepiece, such as on a panel cover. This is necessary because the correcting methods are so complex that it is not readily understood and visual instructions serve as a reminder to the user of the timepiece. In order to improve the operability of the correcting mechanism, the number of buttons is increased which raises the cost for the production of the case, degrades the water-proofing properties of the case and leads to performance failures due to the more complex construction. Accordingly, correcting operations can be simplified to a great extent when corrections of both the analog and digital displays are accomplished by a mechanism wherein a crown is wound. This advantage is especially compelling when the mechanism is similar in operation to the operational methods for correction used in a conventional analog timepiece having date and day displays.

Figure 1:
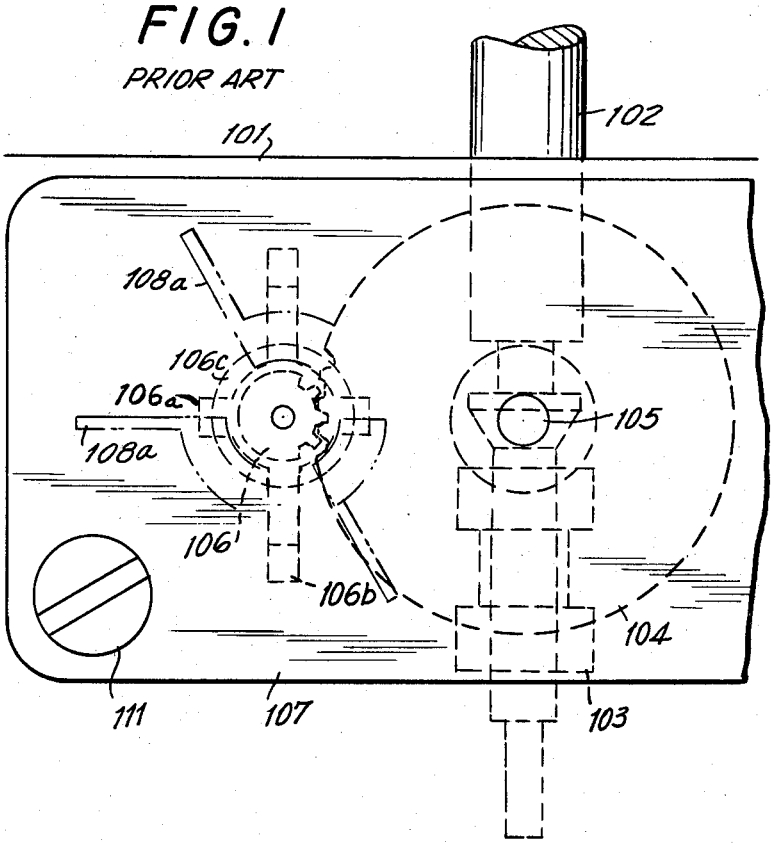
FIG. 1 PRIOR ART
FIG. 1 is a partial top plan view of a conventional display correcting mechanism.
Figure 2:
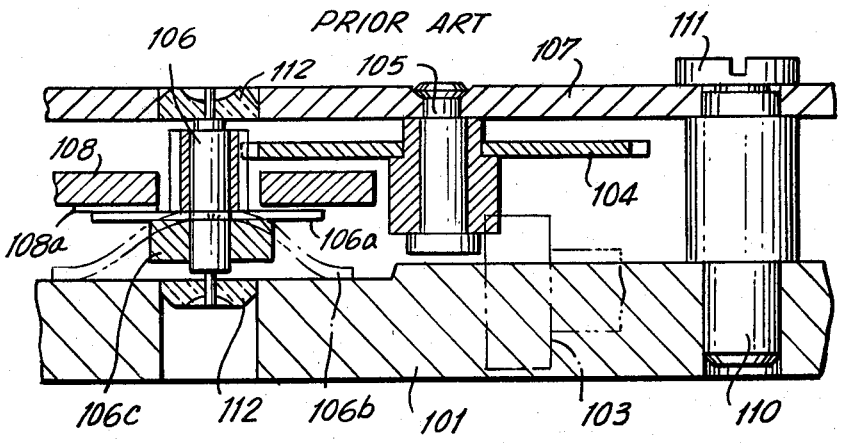
FIG. 2 PRIOR ART
FIG. 2 is a sectional view of the correcting mechanism of FIG. 1.

FIGS. 1 and 2 shown a digital display correcting condition using such a system which is now briefly described. When the crown (not shown) is wound, a winding stem 102, mounted on a mainplate 101 is caused to rotate. The winding stem 102 rotates a switch pinion 106 through a sliding pinion 103 and an intermediate wheel 104. The intermediate wheel 104 is comprised of a wheel pinion meshing with the sliding pinion 103 and an associated wheel. The intermediate wheel 104, thus constructed, is rotatably mounted on a bridge 107 by means of an axle 105. The switch pinion 106 is comprised of a pinion, a switch spring having two arm portions 106*a* in contact with a printed circuit board 108, and a spring portion 106*b*. The switch spring also has a wheel ring 106*c* fixing the switch spring and the pinion. The printed circuit board 108 is formed with three conductor patterns 108*a*, which are symmetrically arranged about a center axis of the switch pinion 106 such that the switch is turned on when the two arm portions 106*a* of the switch pinion 106 come into contact with the conductor patterns 108*a*. Thus, the two arms 106*a* and the three patterns 108*a* are used to detect the rotating direction of the winding stem 102. Two pins and screws 110,111 respectively (only one set is shown) fix the relative positions of the bridge 107 and the mainplate 101. The mainplate 101 and the bridge 107 are fitted with jewels 112 for supporting the switch pinion 106. Operations of the setting components such as a setting lever, a yoke or a yoke holder are not described herein, but are conventional in construction.

As stated above, the conventional correcting mechanism has a large number of components. Moreover, the rotational direction of the winding stem must be detected. Therefore, the number of conductor patterns is so large as to complicate the integrated circuit structure. Moreover, because the switch cam is not fixed in position, a condition where the switch is turned on may be induced while the timepiece is being worn or carried, such that current consumption is increased unnecessarily. Moreover, the number of parts, for example, intermediate wheel 104, bridge 107, switch pinion 106, which must be assembled into the timepiece is sufficiently large as to raise the production cost.

Figure 3:
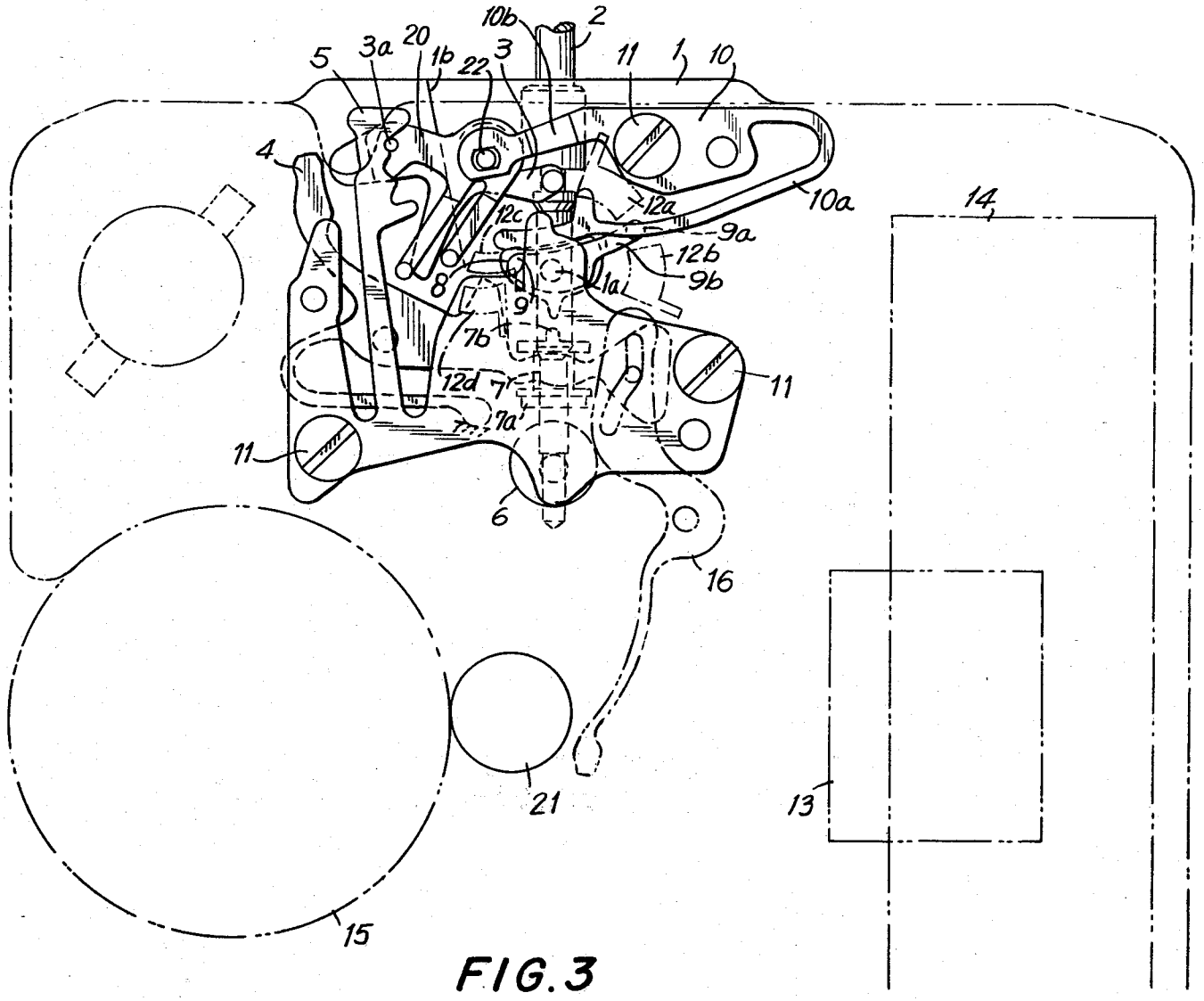
FIGS. 3 and 4 are a partial top plan and sectional view respectively of a correcting mechanism for a timepiece in accordance with this invention.
Figure 4:
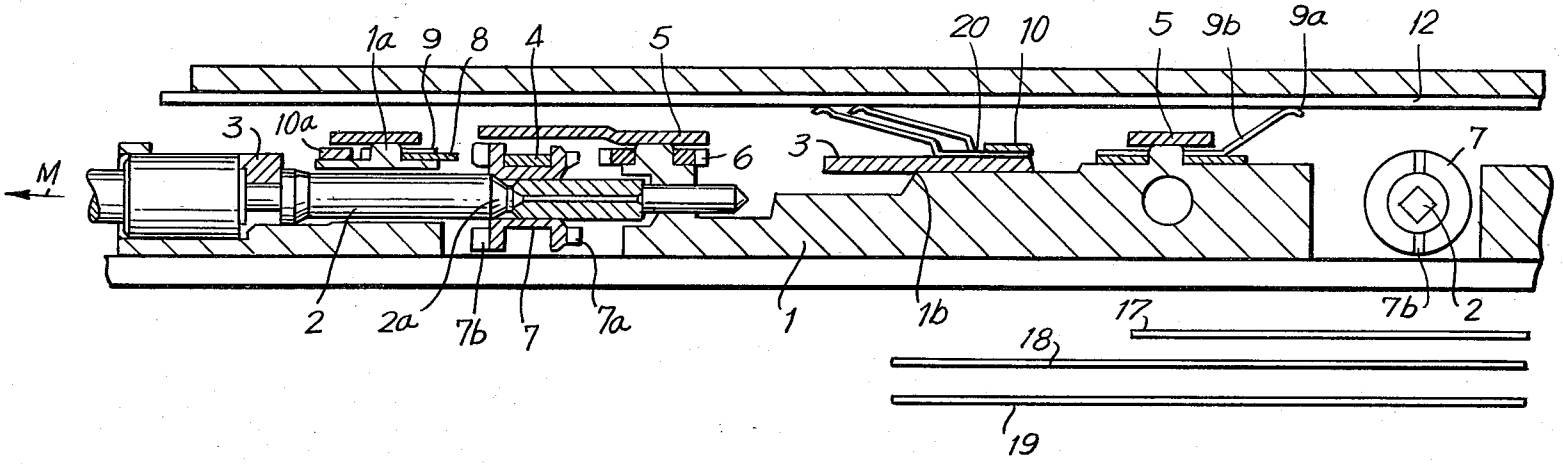

The correcting mechanism for a hybrid display timepiece in accordance with this invention is constructed to eliminate the disadvantages thus far described and is described in detail in the following text with reference to the accompanying drawings:

FIGS. 3 and 4 are a top plan view and sectional view of a correcting mechanism in accordance with this invention, shown in the usual condition as worn or carried.

Figure 5:
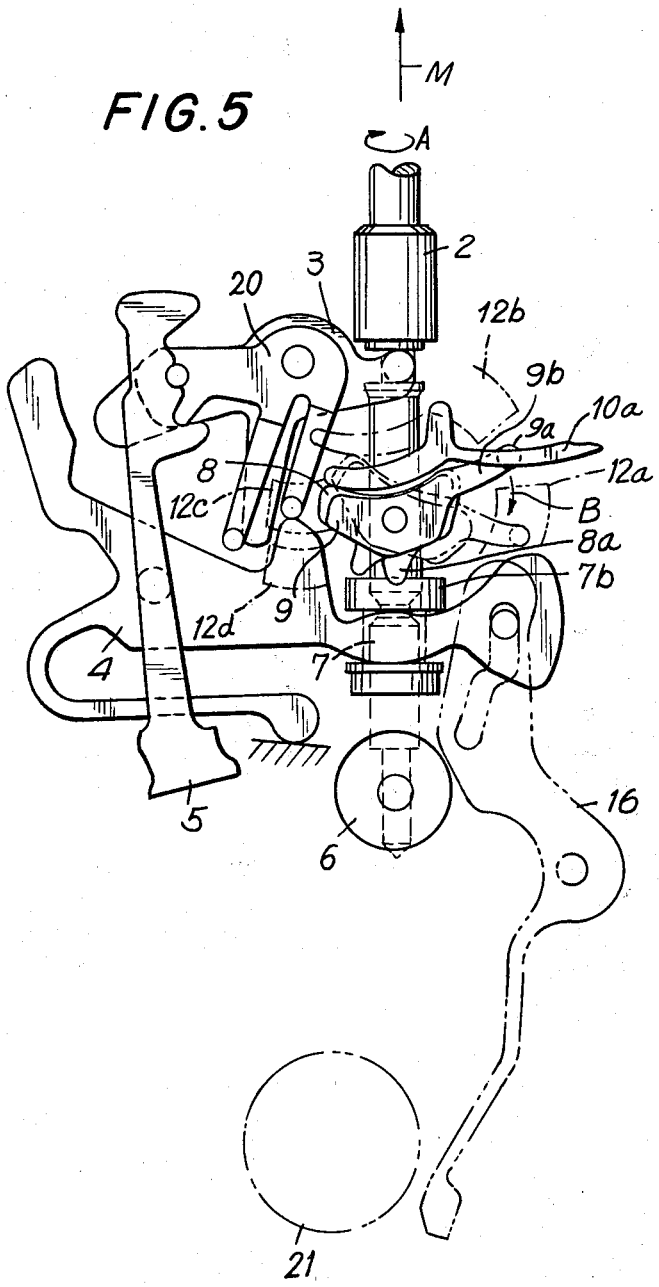

FIG. 5 is a top plan view showing the conditions when the winding stem is drawn out by one step from the usual condition as worn with a view to correcting the digital display.

Figure 6:
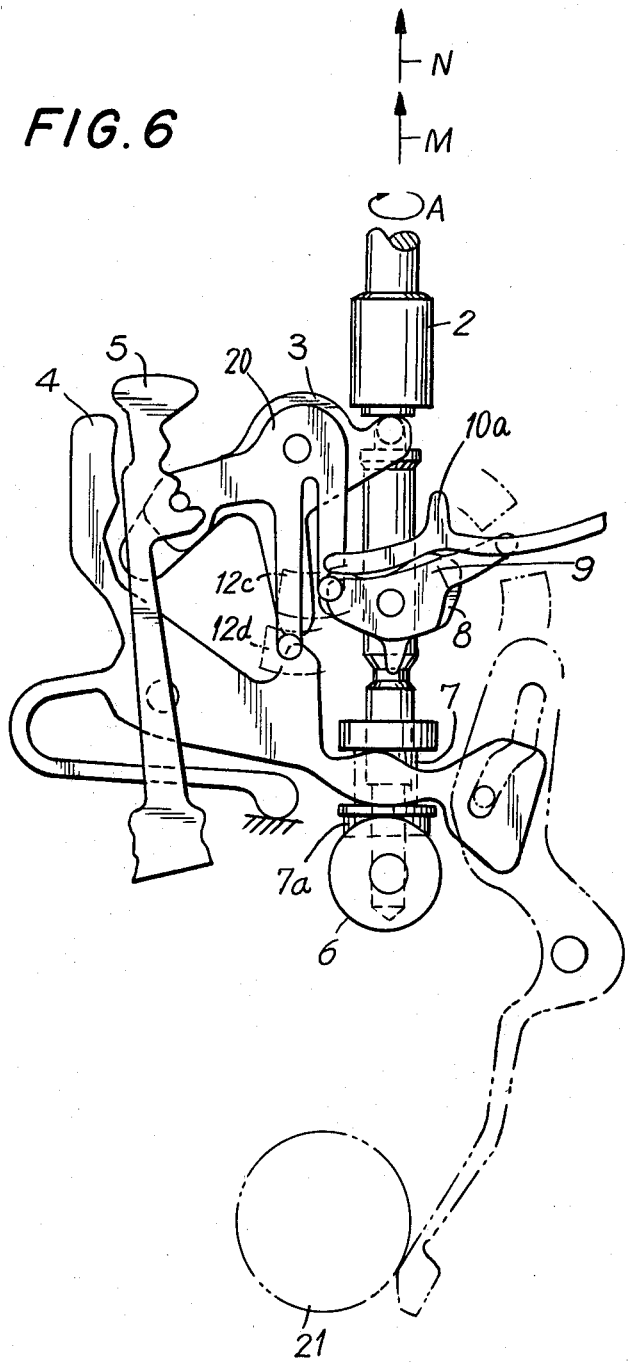

FIG. 6 is a top plan view showing the conditions under which the winding stem is drawn out one more step from the condition of FIG. 5 for the purpose of correcting the analog display, which hereinafter is called the time-setting operation.

With respect to FIGS. 3 and 4, a setting lever, a yoke, and a yoke holder are setting levers for determining three conditions of a timepiece, that is, the usual worn or carried condition, the digital display correcting condition, and the time-setting (analog setting) condition, respectively, in response to pushing and pulling operations of a winding stem 2. The functions and operations of these particular levers are similar to those of the setting mechanism of a conventional analog timepiece with date and day displays and are a novel portion of this invention. Therefore, detailed explanations of these functions are omitted here.

A setting wheel 6 is rotatably mounted on an anchor pin which is a portion of the mainplate 1, and held by a yoke holder 5. A sliding pinion 7 is formed with a rectangular opening and an external groove in which a yoke 4 is engaged. The sliding pinion is mounted on the stem 2 and is provided at its inner most portion within the timepiece with a toothed portion 7*a* and at the other outer end with two pawls 7*b*. The engagement groove is being between the ends as viewed in the top plan view (FIG. 3). The sliding pinion 7, thus constructed, is fitted on a corresponding rectangular portion of the winding stem 2, with the stem 2 passing through the rectangular hole in the sliding pinion 7, such that the pinion 7 slides in the axial direction on the winding stem 2 and rotates with the stem 2.

A switch cam 8 is mounted on an anchor pin 1*a* of the mainplate and having the same positive electrical potential as that of the mainplate 1. The switch cam 8 is mechanically and electrically integrated by a welding or a pin-steaking process with a switch spring 9 having an elastic portion 9*b* pushing against a printed circuit board 12 at all times. The switch spring 9 is held by the yoke holder 5. A setting lever spring 10 is equipped with a spring portion 10*b* holding a setting lever 3 and a setting switch spring 20 at all times. The setting lever spring 10 also includes a jump-preventing spring 10*a* holding the switching cam 8. The jump-preventing spring 10*a* has a portion for abutment formed of a single arc for contact against the switch cam 8.

Screws 11 are used to fasten the setting lever spring 10 and the yoke holder 5 to the mainplate 1. The printed circuit board 12 is formed with electrode patterns which hereinafter may be called the patterns, 12*a*,12*b*,12*c*,12*d*, each of which has one end connected with a MOS integrated circuit 13. A liquid crystal panel 14 is arranged at a desired angle with respect to the plane of the mainplate 1. A battery 15 and an hour hand 17, minute hand 18, and second hand 19, are included, respectively supported by hour, center and second wheels.

A train wheel setting lever 16 is formed with a specially shaped aperture so that the setting lever 16 is actuated by a pin anchored at the yoke 4 only when operation is changed from the digital display to the time-setting condition, thereby to regulate a fifth wheel 21. The fifth wheel 21 forms a part of a wheel train (not shown) as is supplied with the rotating force from an electrical rotor under the usual hand advancing condition by the leading end of that elastic portion. The setting switch spring 20 has its plane position regulated by a protruding pin 3*a* of the setting lever, and by a setting lever axle and is forcibily held by the setting lever spring 10 so that its operation follows the setting lever 3. Moreover, the setting switch spring 20 is formed with two spring portions thrusting against the printed circuit board 12 at all times.

The leading ends of those spring portions of the setting switch spring 20, which contact the printed circuit board 12, are formed to extend from a plane position of a ridge 1*b* of the mainplate. This acts as a fulcrum when the winding stem is pulled out, and this operation is only possible from the usual worn or carried condition, to that ridge portion of the setting lever 3 which acts as a better dynamic point, and which is arranged at an opposite position to the engaging portion between the winding stem 2 and the setting lever 3. As a result, the setting switch spring 20 is never permanently set when the winding stem is pulled out, which would make the connection between the patterns 12*c*,12*d* insufficient. Thus, the switch, which is constructed of the setting switch spring 20 and the patterns 12*c*,12*d*, detects the normal worn or carried condition as well as the digital display correcting and time-setting conditions. The setting switch spring 20 has the same electrical positive potential as that of the mainplate 1. Moreover, the spring portions of the setting switch spring 20 have their leading ends thrusting against the printed circuit board 12 and are made of elastic leaves which have a much wider width in comparison with their thickness and have low inertia. For example, the width/thickness ratio is equal to or larger than 3. As a result, the spring portions are never vibrated by disturbances, such as physical shocks which occur during the normal wearing or carrying operation to the extent that they are brought into contact with the patterns 12*c*,12*d* and thereby induce an erroneous operation of the switch.

The sliding portion 7 in this normally worn or carried non-correcting condition is forced into contact with the tapered portion 2*a* of the winding stem 2 by the yoke spring so that it is held in position. On the other hand, the winding stem 2 in turn has its position controlled by the yoke 4 and the yoke holder 5. The sliding pinion 7 engages neither the switch cam 8 nor the setting wheel 6. The switch spring 9 has its leading end 9*a* thrusting the printed circuit board 12 and held at a neutral position by the actions of the setting lever spring 10 with its jump-preventing spring 10*a*. Accordingly, the switch spring 9 has no contact with the patterns 12*a*,12*b*. As a result, even when the winding stem 2 is turned, the analog and digital displays are unchanged as in a purely mechanical analog timepiece. Also, the switch spring 20 does not contact the patterns 12*c*,12*d* on the printed circuit board 12. The particular parts thus far described are located, except the winding stem 2 and the sliding pinion 7, at the surface of the mainplate 1, specifically, either on the surface of the mainplate 1 or in a space defined between the printed circuit board 12 and the mainplate surface.

As better illustrated in FIG. 5, when the winding stem 2 is drawn out one-step in the direction indicated by the arrow M, the sliding pinion 7 is moved to follow the winding stem 2 by the action of the yoke 4. The sliding pinion 7 moves to a position where it engages with the switch cam 8. When, under this particular condition of positioning, the winding stem 2 is rotated in the direction shown by the arrow A, the pawls 7*b* on the sliding pinion 7 are brought into engagement with a protruding portion 8*a* of the switch cam 8 so that the switch cam 8 is actuated in the direction of the arrow B by the motions of the pawls 7*b*. Thereby, the switch spring 9 moves to contact the pattern 12*a* on the circuit board 12 and is moved to a position which is indicated by double-dotted lines. This is the lower position as seen in FIG. 5.

When the winding stem 2 is rotated further, the engagement between the pawls 7*a* and the protruding finger portion 8*a* of the switch cam 8 is released so that the switch cam 8 returns to the neutral position by the forcing action of the jump-preventing spring 10*a*. Then, if rotation of the winding stem 2 is continued in the same direction, the aforementioned sequence of events is repeated. As a result, the leading end 9*a* of the switch spring 9 is intermittently brought into contact with the pattern 12*a* so that the switch is turned on each time contact is made so as to take down or set back the figure of the digital display. The rotating direction of the winding stem 2 is the same as that by which the hands are set back under the time setting condition.

If, on the other hand, when the winding stem 2 has been pulled out one step and is rotated in the direction opposite to the arrow A, then the leading end 9*a* of the switch spring is brought by action similar to those described immediately above into contact with the pattern 12*b* on the circuit board 12. Thus, opposite rotation of the winding stem 2 moves the leading end 9*a* of the switch spring 9 in the opposite direction. When the leading end 9*a* contacts the patterns 12*b*, the switch is turned on to raise the figure of the digital display. This rotational direction of the winding stem 2 is the same as that by which the hands are set forward in the time-setting mode of operation. In summary, rotation of the stem in the direction of the arrow A sets the digital display back, whereas rotation of the stem 2 in a direction opposite to the arrow A advances the digital display.

As shown in enlarged FIG. 7, operation of the switch cam 8, switch spring 9, and the jump-preventing spring 10*a* occurs such that the conditions indicated by the solid lines, single-dotted lines, double-dotted lines and solid lines are repeated in that order by continuously rotating the winding stem 2 as indicated by the arrow P. That is, the leading end 9*a* advances (lower in FIG. 7) and then returns to the original position, ready to repeat the cycle so long as the winding stem 2 is rotated. The operational contact between the switch cam 8 and the jump-preventing spring 10*a* should be noted. The position of the contacting point shifts in view of the rotational position of the switch cam 8. As a result, there is an advantage that the wear on the switch cam 8 and on the jump-preventing spring 10*a* is reduced by constantly changing the position of the contacting point between these two elements. Thus, the wear is distributed with time over a surface by moving the location where contact is being made. On the other hand, with respect to the shape of the cam 8, the aforementioned contacting points travels on an arc of a single circle. This circle is defined such that the relationship between a distance l between the center of the circle and the axial center of the anchor pin 1*a* of the switch cam 8*a*, and a distance L between that axial center and the leading end 9*a* of the switch spring, that is, the contacting point between the switch spring 9 and the printed circuit board 12 is expressed by an inequality, namely, $l \geqq \frac{5}{8}L$ This relationship reduces the change in the moment required for the jump-preventing spring 10*a* to return the switch cam 8, even when the rotational shift of the switch cam 8 varies as a result of tolerances in the fits and construction of the related parts. Thereby, operations are stabilized.

It should be understood, that similar actions occur in the opposite direction when the stem 2 is rotated in the opposite direction.

FIG. 6 illustrates the condition when the winding stem 2 is further drawn out by one more step in the direction indicated by the arrow N from the condition shown in FIG. 5. The yoke 4 moves toward the setting wheel 6, and the sliding pinion 7 engaged with the yoke 4 is similarly moved toward the setting wheel 6 so that the toothed portion *7a* of the sliding pinion 7 meshes with the setting wheel 6. When the winding stem 2 is rotated, the time-setting operation is effected through the sliding pinion 7 and the setting wheel 6 and through a minute wheel train similarly to the time-setting operation of a conventional analog timepiece having hands for the display. When the winding stem 2 is rotated in the direction of the arrow A, the hands are corrected in a counterclockwise direction, that is, the hands are set back in their time indication. When on the other hand, the winding stem 2 is rotated in a direction opposite to that indicated by the arrow A, the hands are corrected in a clockwise direction, that is, the setting of the hands is advanced. The direction of rotation of the stem 2 and the advancement for retardation of the display is the same for both the digital and the analog displays.

In the time-setting condition (analog), the sliding pinion 7 and the switch cam 8 are not in engagement but the switch cam 8 is held at a neutral position by the action of the jump-preventing spring 10*a* such that the digital display is not corrected when the winding stem is rotated. On the other hand, the switch spring 20 is in contact with the patterns 12*c*,12*d*, and the two switches are turned on. Moreover, the switch of the pattern 12*d* also acts as the analog reset switch. The switch spring 9 has an elastic leaf having a larger width in comparison with its thickness, that is, the ratio of the width to thickness is equal to or greater than 3. Thus, the switch spring 9 has excellent durability which is especially important and necessary because the switch spring 9 is used frequently for correcting the digital display. Further, the train wheel setting lever 16 sets a fifth wheel 21.

Figure 9:
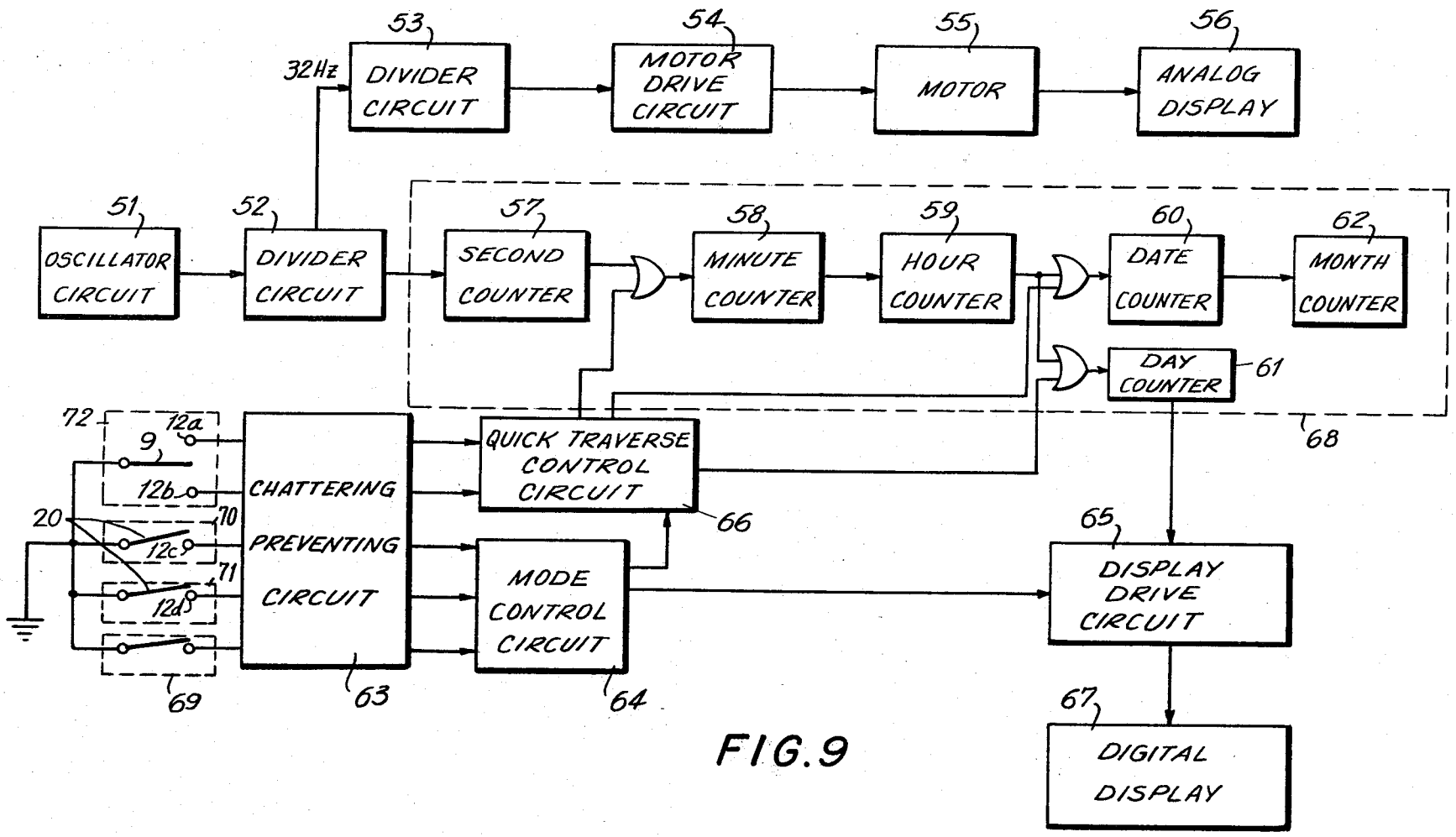
FIG. 9 is block circuit diagram of an electronic timepiece having a hybrid display and including a display correcting mechanism in accordance with this invention.

FIG. 9 is a circuit block diagram for an electronic timepiece having a hybrid display and using the switch structure described above. In the known manner, an oscillator circuit 51, having a quartz crystal resonator, outputs a signal which is divided by divider circuits 52,53. Then, a signal is delivered from the divider circuit 53 to a motor drive circuit 54 to rotationally drive a motor 55 comprising a coil and rotor magnet. As a result, the functions of an analog display 56 are performed. The signal output of the divider circuit 52 is accumulated in a seconds counter 57, minute counter 58, hour counter 59, date counter 60, day counter 61 and month counter 62. These counters are shown in a counter group 68 enclosed in a broken line. The counter group 68 delivers signals for a digital display 67 through a display driving circuit 65. In the display drive circuit 65, mode for display is selected, providing either a display of hour, minute and second, or a display mode for day and date, etc.

There are four switches, that is, a mode changing switch 69, switches 70,71 comprising the contacts of the switch spring 20 and the patterns 12*c*,12*d*, respectively, a switch 72 comprising the switch spring 9 and the patterns 12*a*,12*b* on the circuit board 12, as described above. It is possible to use a switching cam driven by the winding stem for the above mode changing switch 69 as shown in FIG. 8 and described hereinafter. On the other hand, it is possible to have an additional button only for the mode changing switch 69.

The signal output through the switch spring 20 and the pattern 12*d* is connected to the divider circuit for analog display and digital display in order to reset the divider circuit. The reset line is not shown in FIG. 9. It is also practical to reset, in one operation, exclusively a divider circuit for the analog display, or in another operation to reset exclusively the divider circuit for the digital display. The input of the above-mentioned switches is applied to a quick traverse control circuit 66 or a mode control circuit 64 after the impulse passes through a chatter-preventing circuit 63 which eliminates chattering due to the mechanical nature of the switches and forms the wave shapes. The mode control circuit 64 selects the display mode of the digital display 67 in accordance with each input of the switches 69,70,71, and discriminates between the digital display correcting condition and the hands adjustment condition of the timepiece. When the mode control circuit 64 determines that it is in the digital correct condition, the quick traverse control circuit 66 selects the correct speed on the interval of the signal input from the switch 72, so as to output a single step correction signal or a rapid correction signal of many rapid pulses for the correction of the display. Accordingly, when in the mode for displaying hours, minutes and seconds, correction by every single minute, by several minutes, or by a several tens of minutes is performed. The particular circuitry required to perform corrections of this nature and variety are not a novel portion of this invention and are not described in further detail herein for that reason.

As described above, the correcting mechanism in accordance with this invention includes three major parts, that is, the switch cam 8, the switch spring 9 and the jump-preventing spring 10*a*. The jump-preventing spring 10*a* is a part of the setting lever spring 10 such that it has a remarkably simple construction. In the digital display correcting condition, the rotating direction of the winding stem corresponds with the position of a particular contact pattern with which the switch spring is to be brought into contact. Thus, it is unnecessary to have special means or circuits to detect the direction in which the stem 2 is rotated. In the usual worn or carried condition of the timepiece, the switch cam 8 is always in a neutral position, and neither the switch spring or the setting switch spring contact any of the patterns formed on the circuit board 12 such that the current consumption from the battery is minimized. Further, the number of parts which have to be assembled in production is reduced and the constituent parts are simple in themselves. Although, in the embodiment of the correcting mechanism in accordance with this invention as described above, the spring 9 is fixed to the cam 8 in abutting contact with the circuit patterns on the circuit board 12, the spring 9 can be dispensed with and replaced by either a leaf spring sandwiched between the cam and mainplate 1, or by using a printed circuit board constructed to include an elastic member. Moreover, the correcting rate of the digital display can be varied depending on the interval at which the switch is turned on, that is, by the rotating speed of the winding stem. The number of pawls *7b* of the sliding pinion 7 need not be limited to two but can be suitably selected in accordance with the spring constant of the jump-preventing spring 10*a*. Further, although the cam 8 and the jump-preventing spring 10 are separately made they can be integrated to a single component. In these ways, different components can have their functions combined and shared.

Where multiple functions and display modes are incorporated in a timepiece, the display mode to be corrected is selected either by actuating the crown from the usual worn or carried condition, such as by pushing, drawing or rotating the crown, or by actuating another button. Then, the winding stem is drawn out to its position for correction, such that the scope of application is enlarged where the digital display is to be corrected using a mechanism of the embodiment described herein.

In FIG. 8, an alternative embodiment wherein the digital display mode is changed by winding the winding stem in the conventional worn or carried condition is shown. Components in FIG. 8 are identified by adding a value 200 to each reference numeral for the same component in FIG. 7. In FIG. 8, the pawls 207*b* of the pinion 207 are lengthened so that the switch cam 208 can be actuated both in the condition where the winding stem is in the normal worn or carried state and also where the winding stem is drawn out one step from the normal worn or carried position. Actuation of the switch cam 208 in the normal carried or worn state of the winding stem by rotation of the winding stem, causes the switching functions between the contacts 212*a*, 212*b* on the circuit board 212 depending upon the direction of rotation of the stem. As a result, a mode change signal is output. In this Figure, the sliding pinion 207′, shown with broken lines, corresponds to the position of the winding stem in the normal or carried condition.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A correcting mechanism for a hybrid display timepiece including both an analog display and digital display, comprising:

a shaft mounted for rotation, and for translation in the directions of the longitudinal axis of said shaft;

first actuatable means for correcting said digital display;

second actuatable means for correcting said analog display;

a correcting member, said correcting member being slidably mounted on said shaft and for rotation therewith, said correcting member having a first portion adapted to actuate said first means for correcting said digital display and a second portion adapted for actuating said second means for correcting said analog display;

means cooperating with said shaft for translatting said correcting member, when said shaft translates, whereby said correcting member is selectively positioned to engage one of said first and second means for actuating.

2. A correcting mechanism as claimed in claim 1, wherein said second portion of said correcting member includes a toothed gear, and said second actuatable means for correcting said analog display includes a correcting wheel train connected with analog display members, said toothed gear engaging said correcting wheel train when said correcting member is selectively positioned to engage said second means for actuating.

3. A correcting mechanism as claimed in claim 2, wherein rotation of said shaft causes rotation of said toothed gear and, when engaged, said correcting wheel train, whereby said analog display is corrected.

4. A correcting mechanism as claimed in claim 3, wherein the direction of rotation of said gear train depends upon the rotational direction of said shaft.

5. A correcting mechanism as claimed in claim 1 or 3, wherein said first portion of said correcting member includes at least one pawl, and said actuatable means for correcting said digital display includes cam means, said at least one pawl engaging said cam means when said correcting member is selectively positioned to engage said first means for actuating.

6. A correcting mechanism as claimed in claim 5, wherein rotation of said shaft causes rotation of said at least one pawl and, when engaged, said cam means is driven by said at least one pawl.

7. A correcting mechanism as claimed in claim 6, wherein said cam means when driven, pivots about an axis, and the direction of rotation of said cam means about said cam axis depends upon the rotational direction of said shaft.

8. A correcting mechanism as claimed in claim 7, wherein said cam means includes a first electrical contact, and said second means for correcting said analog display includes a plurality of electrical contacts, said cam means when pivoted in one direction causing an electrical connection between said first cam contact and one of said plurality of contacts of said second means for correcting, said cam means when pivoted in the other direction contacting another one of said plurality of contacts in said second actuatable means for correcting said analog display, whereby said analog display means may have two modes of operation when said stem is turned, said mode of operation depending upon the rotational direction of said shaft.

9. A correcting mechanism as claimed in claim 8, and further comprising a return spring, and wherein said cam means rotates about said cam means axis in opposition to the force of said return spring.

10. A correcting mechanism as claimed in claim 9, wherein said cam means is contoured to cause said cam means to oscillate about said cam means axis when said shaft is continuously rotated, said connections between said first electrical contact on said cam means and said connections on said second means for correcting said analog display are intermittently opened and closed, whereby repetitive corrections are made to said analog display.

11. A correcting mechanism as claimed in claim 10, wherein said shaft is adaptable for translation to a neutral position, said correction member being disengaged from both said first and second means for actuating when said shaft is in said neutral position, whereby rotation of said shaft in said neutral position causes no correction to said analog and digital displays.

12. A correcting mechanism as claimed in claim 11, wherein said plurality of electrical contacts in said second means for correcting said analog display are on a circuit board, said contact of said cam means being continuously pressed against said circuit board, said contacts on said circuit board forming patterns covering a portion of the surface of said circuit board, said connections between said first cam means contact and said circuit board patterns, being made only when said shaft is positioned to engage said second actuatable means and is rotated.

13. A correcting mechanism as claimed in claim 5, and further comprising a return spring, and wherein said cam means rotates about said cam means axis in opposition to the force of said return spring.

14. A correcting mechanism as claimed in claim 1, wherein said selected and engaged means for actuating is activated by rotation of said shaft.

15. A correcting mechanism as claimed in claim 14, wherein said shaft is adaptable for translation to a neutral position, said correcting member being disengaged from both said first and second means for actuating when said shaft is in said neutral position, whereby rotation of said shaft in said neutral position causes no correction to said analog and digital displays.

16. A correcting mechanism as claimed in claim 11, wherein said at least one pawl and said cam are partially engaged in said neutral position, rotation of said shaft causing the performance of an additional function, said additional function being independent of correction of said displays.

* * * * *